US007133034B2

(12) United States Patent
Park et al.

(10) Patent No.: US 7,133,034 B2
(45) Date of Patent: Nov. 7, 2006

(54) GATE SIGNAL DELAY COMPENSATING LCD AND DRIVING METHOD THEREOF

(75) Inventors: Haeng-Won Park, Seongnam (KR); Jung-Hee Lee, Suwon (KR)

(73) Assignee: Samsung Electronics Co., Ltd. (KR)

( * ) Notice: Subject to any disclaimer, the term of this patent is extended or adjusted under 35 U.S.C. 154(b) by 218 days.

(21) Appl. No.: 09/985,030

(22) Filed: Nov. 1, 2001

(65) Prior Publication Data

US 2002/0084968 A1 Jul. 4, 2002

(30) Foreign Application Priority Data

Jan. 4, 2001 (KR) ..... 2001-420

(51) Int. Cl.
*G09G 3/36* (2006.01)

(52) U.S. Cl. ..... 345/204; 345/87; 345/98; 345/100

(58) Field of Classification Search ..... 345/87–102, 345/690, 204
See application file for complete search history.

(56) References Cited

U.S. PATENT DOCUMENTS 5,602,560 A * 2/1997 Ikeda ..... 345/94
5,841,415 A 11/1998 Kwon et al.
5,995,075 A 11/1999 Vignolle et al.
6,246,385 B1 * 6/2001 Kinoshita et al. ..... 345/87
6,407,729 B1 * 6/2002 Moon ..... 345/99

FOREIGN PATENT DOCUMENTS

EP 0 780 826 6/1997

* cited by examiner

*Primary Examiner*—Richard Hjerpe
*Assistant Examiner*—Duc Q Dinh
(74) *Attorney, Agent, or Firm*—MacPherson Kwok Chen & Heid LLP; David S. Park

(57) ABSTRACT

Disclosed is a gate signal delay compensating LCD that comprises an LCD panel including a plurality of gate lines, a plurality of data lines insulated from and crossing the gate lines, a plurality of TFT each of which having a gate electrode connected to the gate line and a source electrode connected to the data line, a pixel electrode connected to a drain electrode of the TFT and a common electrode facing the pixel electrode, liquid crystal filled between the pixel electrode and the common electrode, and a signal delay compensator connected to ends of the gate lines to compensate for the gate signal delay; a gate driver for supplying a gate signal for turning on and off the TFT to the gate line so as to drive the LCD panel; a data driver for supplying a data voltage that represents an image signal to the data line so as to drive the LCD panel; and a signal controller connected to a signal source, the gate driver and the data driver, and processing the image signal provided by the signal source to enable the gate driver to supply a signal for turning on the TFT and the data driver to supply a data voltage to the pixel.

26 Claims, 3 Drawing Sheets

GATE SIGNAL DELAY COMPENSATING LCD AND DRIVING METHOD THEREOF

BACKGROUND OF THE INVENTION (a) Field of the Invention

The present invention relates to an LCD, a panel and a method for compensating for gate signal delay. More specifically, the present invention relates to an apparatus and a method for providing a gate signal delay compensating LCD, a panel and a method to be easily implemented without an additional driving integrated circuit (IC) and to compensate for gate-on signal delay due to resistance and capacitance of a gate line without unnecessarily affecting the LCD panel characteristics.

(b) Description of the Related Art

The thin film transistor liquid crystal display (TFT-LCD) is one of major LCDs, and a target project for the LCD is to increase the size of the LCD panel as well as its resolution. The bigger size and higher resolution of the LCD panel requires longer data lines and gate lines in the panel, which increases line resistance. More crossover points between the lines increase parasitic capacitance of each line. Particularly, when designing a panel of high through-hole ratio to be required in the future, the increased overlaps of the pixels and lines delay signals greatly.

FIG. 3 shows the above-described gate signal delay of a conventional LCD panel. Referring to FIG. 3, a gate signal is provided as a square wave at an input point. However, when transmitted to a corresponding line on the panel, the signal is delayed at an end of the gate line because of the line resistance and capacitance. Accordingly, the square wave is distorted. The gate signal at the end of the gate line has a delayed waveform because of the distortion. The gate signal delay worsens charging characteristics of each pixel in the LCD panel, because the longer signal delay shortens the gate-on interval of the gate signal. This causes the charging amount at each pixel to fall short from the specification.

To solve the deteriorated image problem caused by the signal delay at the large LCD panel of high resolution, a driving method for supplying signals at both ends of the gate lines on the LCD panel is suggested. However, this method increases the number of driver IC, and therefore, hindering cost competitiveness.

SUMMARY OF THE INVENTION

It is an object of the present invention to provide a gate signal delay compensating LCD, its panel and its driving method to be easily implemented without an additional driving integrated circuit (IC). It compensates the delay of a gate-on signal caused by resistance and capacitance of a gate line without providing unnecessary effects to characteristics of the LCD panel.

In one aspect of the present invention, a gate signal delay compensating LCD comprises an LCD panel including a plurality of gate lines, a plurality of data lines insulated from and crossing the gate lines, a plurality of TFT each of which having a gate electrode connected to the gate line and a source electrode connected to the data line, and a signal delay compensator having a pixel electrode connected to a drain electrode of the TFT and a common electrode facing the pixel electrode and supplying a common voltage, having liquid crystal filled between the pixel electrode and the common electrode, and connected to ends of the gate lines to compensate for the gate signal delay; a gate driver for supplying a gate signal for turning on and off the TFT to the gate line so as to drive the LCD panel; a data driver for supplying a data voltage that represents an image signal to the data line so as to drive the LCD panel; and a signal controller connected to a signal source, the gate driver and the data driver, and processing the image signal provided by the signal source to enable the gate driver to supply a signal for turning on the TFT and the data driver to supply a data voltage to the pixel.

The signal delay compensator of the LCD panel comprises a plurality of delay compensation elements each of which connected to an end of the gate line; and a compensation voltage transmission line connected to the delay compensation elements, receiving a predetermined DC voltage from the outside of the LCD panel and transmitting the same to the delay compensation elements.

The delay compensation element comprises a diode having a current output end connected to an end of the gate line and having a current input end connected to the source electrode of the TFT, and enabling the current to flow in the direction only from the current input end to the current output end; and a delay compensation TFT having a gate electrode connected to the current output end of the diode and the gate line, a source electrode connected to the current input end of the diode and a drain electrode connected to the compensation voltage transmission line so as to enable the current for compensating for the voltage to flow from the drain electrode to the source electrode according to the voltage difference between the gate and source electrodes.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

In the following detailed description, only the preferred embodiment of the invention has been shown and described, simply by way of illustrating the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Figure 1:
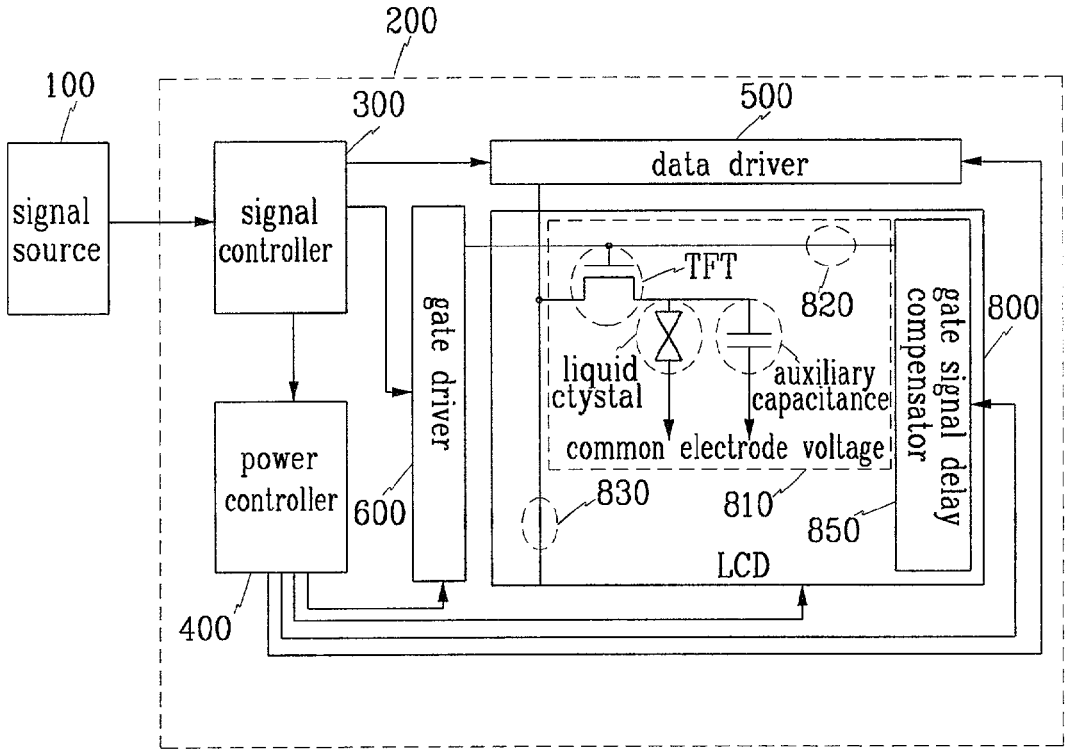
FIG. 1 shows a gate signal delay compensating LCD according to a preferred embodiment of the present invention.

FIG. 1 shows a gate signal delay compensating LCD according to a preferred embodiment of the present invention.

As shown, the gate signal delay compensating LCD comprises an LCD panel 800 including a plurality of gate lines 820, a plurality of data lines 830, a plurality of TFTs each of which having a gate electrode and a source electrode, a pixel electrode, a common electrode, liquid crystal filled between the pixel electrode and the common electrode, and a signal delay compensator 850 connected to ends of the gate lines 820 to compensate for the gate signal delay; a gate driver 600; a data driver 500; a signal source 100; and a signal controller 300.

Figure 2:
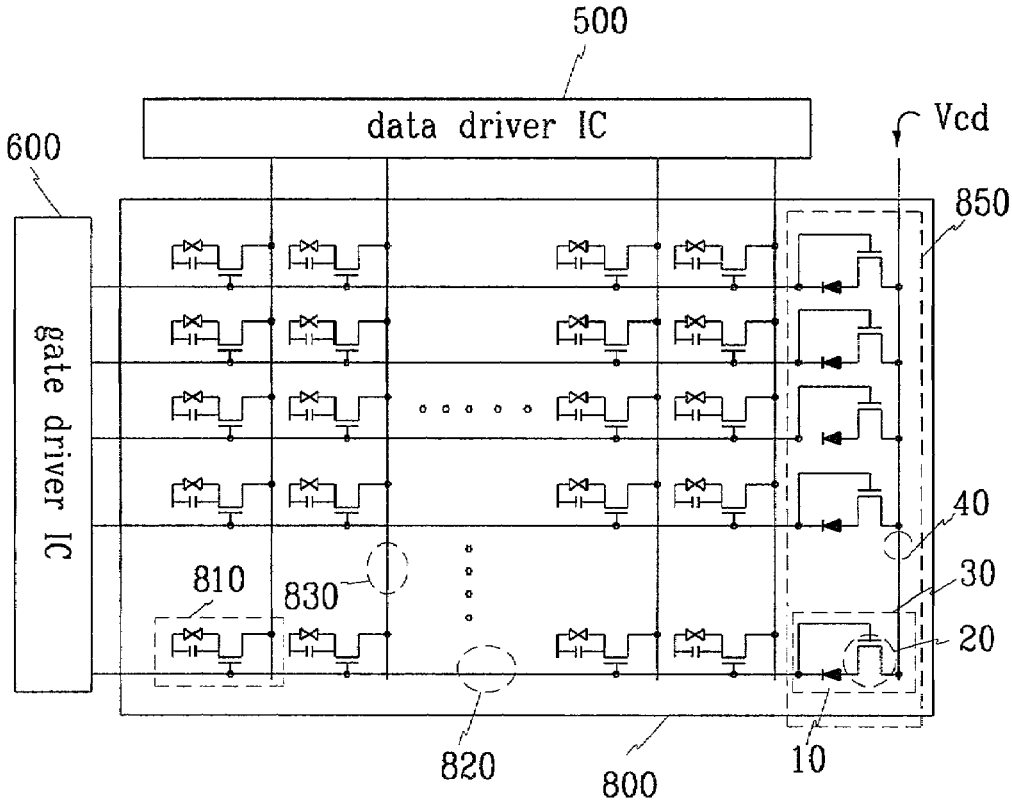
FIG. 2 shows a gate signal delay compensating LCD panel according to a preferred embodiment of the present invention.

FIG. 2 shows a gate signal delay compensating LCD panel according to a preferred embodiment of the present invention.

As shown, the gate signal delay compensating LCD panel comprises a plurality of gate lines 820; a plurality of data lines 830; a plurality of TFTs; a pixel electrode; a common electrode; liquid crystal, and a signal delay compensator 850 connected to ends of the gate lines and compensating for gate signal delay. Here, the signal delay compensator 850 is connected to a plurality of delay compensation elements 30, and comprises a compensation voltage transmission line 40 for receiving a predetermined direct current (DC) voltage from the outside of the LCD panel and transmitting the same to the respective delay compensation elements.

Also, the delay compensation element 30 comprises a diode 10 having a current output end connected to an end of the gate line 820 and a current input end to a source electrode of the TFT 20 in order to flow the current only in the direction from the current input end to the current output end; and a delay compensation TFT 20 having a gate electrode connected to the current output end of the diode 10 and the gate line, a source electrode to the current input end of the diode 10, and a drain electrode to the compensation voltage transmission line 40 in order to flow the voltage compensation current from the drain electrode to the source electrode according to a voltage difference between the gate and source electrodes.

Figure 3:
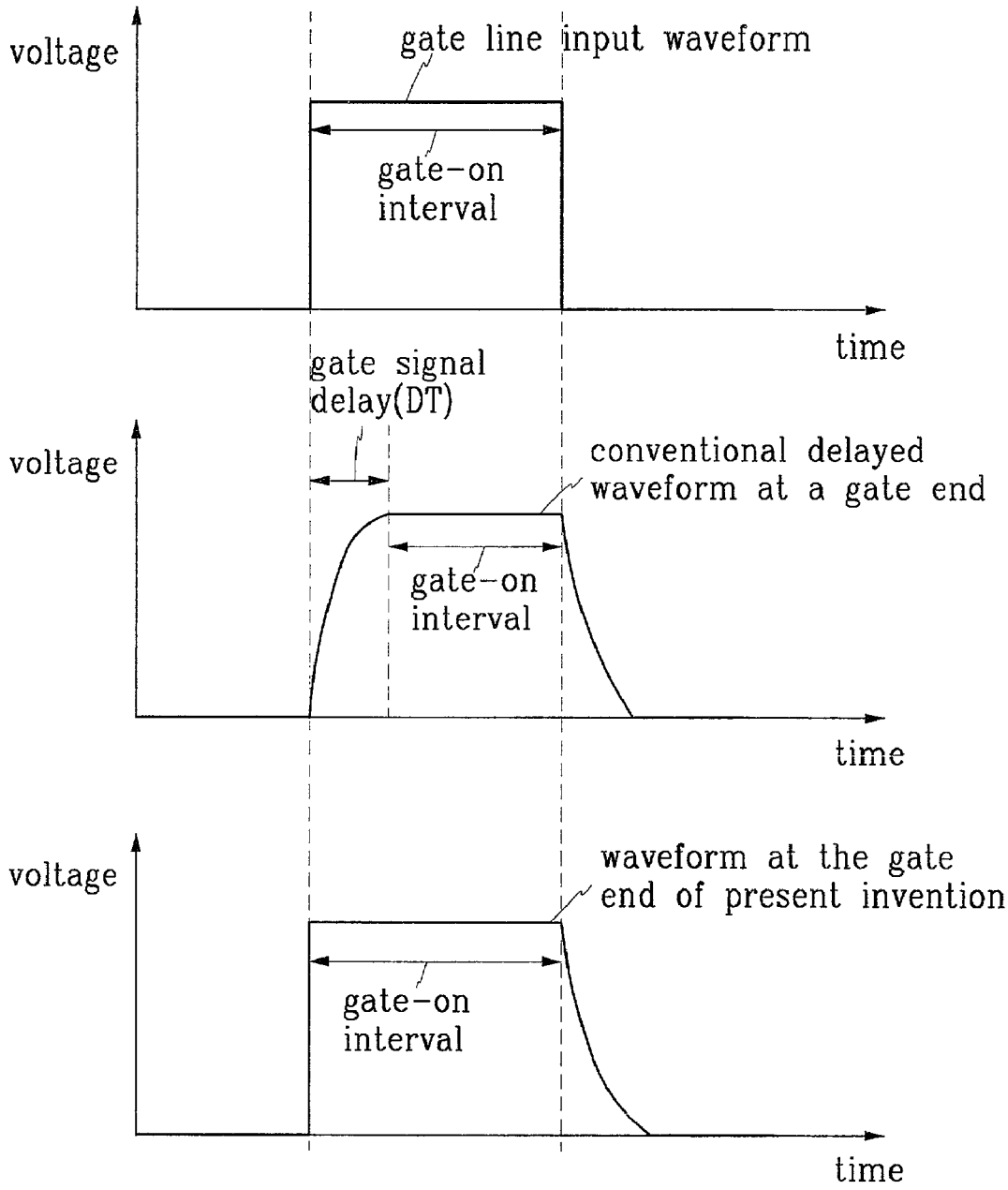
FIG. 3 shows a gate signal having a compensated signal delay compared to the delayed gate signal of the conventional device.

FIG. 3 shows a gate signal having a compensated signal delay compared with the delayed gate signal in the conventional device.

As shown, the gate signal delay is compensated, and the gate-on interval during which the gate end maintains high level is recovered to the state of the gate line input waveform of FIG. 3. Accordingly, the problem of shortened charging time caused by the gate signal delay can be overcome.

When the delayed gate signal is input from the end of the gate line, the voltage of reverse direction is supplied to the diode 10 of the delay compensation element 30, and the current cannot flow through the diode 10. Thus, only the gate voltage of the delay compensating TFT 20 connected to the gate line is increased, and a voltage difference between the gate electrode and source electrode of the TFT 20 is generated, and when the above-noted voltage difference is greater than the threshold voltage, the delay compensating TFT 20 is switched on.

Accordingly, the compensation current flows from the compensation voltage transmission line 40 connected to the drain electrode of the delay compensating TFT 20 until the potential of the drain electrode becomes equivalent to that of the source electrode. And the potential of the gate line is increased because of the current, and the gate signal delay is compensated. Finally, the waveform of the gate signal as shown at the bottom of FIG. 3 is obtained.

Also, since no voltage increase as much as the delayed signal is generated at the gate electrode of the delay compensating TFT 20 connected to another gate line to which no gate signal is supplied, the delay compensating TFT 20 cannot be switched on, and as a result, since only the gate line to which the delayed gate signal is supplied is selectively connected to the compensation voltage transmission line 40, an image deterioration problem occurring when another gate line that is not to be driven is concurrently driven is not generated.

The present invention provides a gate signal delay compensating LCD, its panel and its driving method to be easily implemented without an additional driving integrated circuit (IC). The present invention compensates for the delay of a gate-on signal caused by resistance and capacitance of a gate line without unnecessarily affecting the LCD panel characteristics.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A gate signal delay compensating liquid crystal display (LCD), comprising:

an LCD panel comprising:

a plurality of gate lines;

a plurality of data lines insulated from and crossing the plurality of gate lines;

a plurality of thin film transistors (TFT) each of which having a gate electrode connected to one of the plurality gate lines and a source electrode connected to the data line;

a pixel electrode connected to a drain electrode of the TFT;

a common electrode facing the pixel electrode;

liquid crystal filled between the pixel electrode and the common electrode;

a signal delay compensator connected to ends of the plurality of gate lines;

a gate driver for supplying a gate signal for turning on and off the TFT to the plurality of gate lines to drive the LCD panel;

a data driver for supplying a data voltage that represents an image signal to the plurality of data lines to drive the LCD panel; and a signal controller connected to a signal source, the gate driver and the data driver, and processing the image signal provided by the signal source to enable the gate driver to supply a signal for turning on the TFT and the data driver to supply a data voltage to the pixel electrode, wherein the signal delay compensator provides a compensation signal that compensates for delay of a gate-on signal.

2. The LCD of claim 1, wherein the signal delay compensator of the LCD panel comprises:

a plurality of delay compensation elements, each of which connected to an end of the plurality of gate lines; and a compensation voltage transmission line connected to the delay compensation elements, receiving a predetermined DC voltage from outside of the LCD panel and transmitting the same to the delay compensation elements.

3. The LCD of claim 2, wherein at least one of the plurality of delay compensation elements comprises:

a diode having a current output end connected to an end of at least one of the plurality of gate lines and having a current input end connected to the source electrode of the TFT, and enabling the current to flow in the direction only from the current input end to the current output end; and a delay compensation TFT having a gate electrode connected to the current output end of the diode and the gate line, a source electrode connected to the current input end of the diode and a drain electrode connected to the compensation voltage transmission line so as to enable the current for compensating for the voltage to flow from the drain electrode to the source electrode according to the voltage difference between the gate electrode and the source electrode.

4. A liquid crystal display (LCD) panel, comprising:

a plurality of gate lines;

a plurality of data lines insulated from and crossing the plurality of gate lines;

a plurality of thin film transistors (TFT) each of which having a gate electrode connected to one of the plurality of the gate lines and a source electrode connected to the data line;

a pixel electrode connected to a drain electrode of the TFT;

a common electrode facing the pixel electrode;

liquid crystal filled between the pixel electrode and the common electrode; and a signal delay compensator connected to ends of the gate lines, wherein the signal delay compensator enables a compensation signal that compensates for delay of a gate-on signal to be provided for at least one of the plurality of gate lines.

5. The LCD panel of claim 4, wherein the signal delay compensator comprises:

a plurality of delay compensation elements, each connected to an end of the plurality of gate lines; and a compensation voltage transmission line connected to the delay compensation elements, receiving a predetermined DC voltage from outside of the LCD panel and transmitting the same to the respective delay compensation elements.

6. The LCD panel of claim 5, wherein the plurality of delay compensation elements comprise:

a diode having a current output end connected to an end of at least one of the plurality of the gate lines and having a current input end connected to the source electrode of a TFT, and enabling the current to flow in the direction only from the current input end to the current output end; and a delay compensation TFT having a gate electrode connected to the current output end of the diode and at least one of the plurality of the gate lines, a source electrode connected to the current input end of the diode and a drain electrode connected to the compensation voltage transmission line so as to enable the current for compensating for the voltage to flow from the drain electrode to the source electrode according to the voltage difference between the gate electrode and the source electrode.

7. A signal delay compensating circuit for a liquid crystal display (LCD) panel having a plurality of thin film transistors (TFT) and compensating for signal delay of a gate line by providing a compensation signal that compensates for delay of a gate-on signal for the gate line, the signal delay compensating circuit, comprising:

a plurality of delay compensation elements each connected to an end of the gate line; and a compensation voltage transmission line connected to the delay compensation elements, receiving a predetermined DC voltage from outside of the LCD panel and transmitting the same to the respective delay compensation elements.

8. The signal delay compensating circuit of claim 7, wherein at least one of the delay compensation element comprises:

a diode having a current output end connected to an end of the gate line and having a current input end connected to a source electrode of a TFT, and enabling current to flow in the direction only from the current input end to the current output end; and a delay compensation TFT having a gate electrode connected to the current output end of the diode and the gate line, a source electrode connected to the current input end of the diode and a drain electrode connected to the compensation voltage transmission line so as to enable the current for compensating for the voltage to flow from the drain electrode to the source electrode according to the voltage difference between the gate electrode and the source electrode.

9. A method of compensating a signal delay of a gate-on signal in a gate line of a liquid crystal display panel, the method comprising:

applying a gate signal to a first end of a gate line to turn on thin film transistors (TFT) connected to the gate line; and supplying a DC voltage to a second end of the gate line that compensates for delay of the gate-on signal in turning on the TFTs.

10. The method of claim 9, wherein the method compensates a signal delay in a gate line of a display panel, using a signal delay compensating circuit including a plurality of delay compensation elements, and at least one of the plurality of delay compensation elements comprise:

a diode having a current output end connected to an end of the gate line and having a current input end connected to a source electrode of a TFT, and enabling current to flow in the direction only from the current input end to the current output end; and a delay compensation TFT having a gate electrode connected to the current output end of the diode and the gate line, a source electrode connected to the current input end of the diode and a drain electrode connected to the compensation voltage transmission line so as to enable the current for compensating for the voltage to flow from the drain electrode to the source electrode according to the voltage difference between the gate electrode and the source electrode.

11. A signal delay compensating circuit for a flat panel display having a plurality of thin film transistors (TFT), comprising:

a plurality of delay compensation elements each connected to an end of a plurality of gate lines; and a compensation voltage transmission line electrically connected to the plurality of delay compensation elements and electrically connected to a voltage supply arranged outside of the flat panel display, wherein the signal delay compensating circuit substantially minimizes gate signal delay and enables a compensation signal that compensates for delay of a gate-on signal to be provided for the plurality of gate lines.

12. The signal delay compensating circuit of claim 11, wherein at least one of the plurality of delay compensation elements, further comprises:

a diode having a current output end connected to an end of one of the plurality of gate lines;

a current input end connected to a source electrode of a transistor, wherein current can flows from the current input end to the current output end; and a delay compensation transistor having a gate electrode connected to the current output end of the diode and at least one of the plurality of the gate lines, a source electrode connected to the current input end of the diode and a drain electrode connected to the compensation voltage transmission line so as to enable the current for compensating for the voltage to flow from the drain electrode to the source electrode according to the voltage difference between the gate electrode and the source electrode.

13. The signal delay compensating circuit of claim 11, wherein the flat panel display is a liquid crystal display (LCD).

14. The signal delay compensating circuit of claim 13, wherein the liquid crystal display (LCD), comprises:

a plurality of data lines insulated from and crossing the plurality of gate lines;

a plurality of transistors each having a gate electrode connected to the gate line and a source electrode connected to the data line;

a pixel electrode connected to a drain electrode of each of the plurality of transistors;

a common electrode facing the pixel electrode;

liquid crystal filled between the pixel electrode and the common electrode; and a gate driver for supplying the gate signal for turning on and off the transistors electrically connected to the plurality of gate lines.

15. A liquid crystal display comprising:

a plurality of switching devices arranged in a matrix;

a plurality of gate lines connected to the switching devices and transmitting gate-on signals to turn-on the switching devices;

a plurality of data lines crossing the gate lines; and a signal delay compensator connected to the gate lines and operating in response to the gate-on signals from the gate lines to compensate signal delay of the gate-on signals.

16. The liquid crystal display of claim 15, wherein the signal delay compensator compensates the signal delay by using a predetermined voltage from an external device.

17. The liquid crystal display of claim 16, wherein the signal delay compensator comprises a plurality of delay compensation elements connected to one end of the respective gate lines.

18. The liquid crystal display of claim 17, wherein each delay compensation element comprises a transistor turned-on by the gate-on signal to transmit the predetermined voltage.

19. The liquid crystal display of claim 18, wherein the transistor comprises first and second terminals connected to the gate line and a third terminal supplied with the predetermined voltage.

20. The liquid crystal display of claim 18, wherein each delay compensation element further comprises a diode connected in a forward direction from the transistor to the gate line.

21. A liquid crystal display panel, comprising:

a plurality of switching devices arranged in a matrix;

a plurality of gate lines connected to the switching devices and transmitting gate-on signals to turn-on the switching devices;

a plurality of data lines crossing the gate lines;

a plurality of thin film transistors connected to the gate lines and the data lines and turning on in response to the gate-on signals from the gate lines;

a plurality of pixel electrodes connected to the thin film transistors;

a common electrode facing the pixel electrodes;

liquid crystal filled between the pixel electrodes and the common electrode; and a signal delay compensator connected to the gate lines and operating in response to the gate-on signals from the gate lines to compensate signal delay of the gate-on signals.

22. The liquid crystal display panel of claim 21, wherein the signal delay compensator compensates the signal delay by using a predetermined voltage from an external device.

23. The liquid crystal display panel of claim 22, wherein the signal delay compensator comprises:

a plurality of delay compensation elements connected to one ends of the respective gate lines; and a compensation voltage transmission line connected to the delay compensation elements, receiving the predetermined voltage, and transmitting the predetermined voltage to the delay compensation elements.

24. The liquid crystal display panel of claim 23, wherein each delay compensation element comprises a transistor connected between the gate line and the compensation voltage transmission line.

25. The liquid crystal display panel of claim 24, wherein each delay compensation element further comprises a diode connected in a forward direction from the transistor to the gate line.

26. A method of compensating signal delay of gate-on signals of a liquid crystal display including a plurality of gate lines, a plurality of switching devices, and a signal delay compensator, the method comprising:

applying the gate-on signals to the gate lines to activate the switching devices and the signal delay compensator; and applying a predetermined voltage through the signal delay compensator to the gate lines to compensate for the delay of the gate-on signals.

* * * * *